US006570090B1

(12) United States Patent
Boy et al.

(10) Patent No.: US 6,570,090 B1
(45) Date of Patent: May 27, 2003

(54) ELECTRICALLY CONDUCTIVE CONNECTION BETWEEN A TERMINAL ELECTRODE AND A CONNECTING WIRE

(75) Inventors: Jürgen Boy, Berlin (DE); Frank Bothe, Berlin (DE); Jürgen Pries, Berlin (DE)

(73) Assignee: EPCOS Aktiengesellschaft, München (DE)

( * ) Notice: Subject to any disclaimer, the term of this patent is extended or adjusted under 35 U.S.C. 154(b) by 0 days.

(21) Appl. No.: 10/018,230

(22) PCT Filed: Jun. 7, 2000

(86) PCT No.: PCT/DE00/01861

§ 371 (c)(1),
(2), (4) Date: Dec. 12, 2001

(87) PCT Pub. No.: WO00/77899

PCT Pub. Date: Dec. 21, 2000

(30) Foreign Application Priority Data

Jun. 16, 1999 (DE) ..... 199 28 320

(51) Int. Cl.[7] ..... H01J 5/32

(52) U.S. Cl. ..... 174/50.58; 174/50.61; 174/50.5

(58) Field of Search ..... 174/50.58, 50.59, 174/50.61, 94 R, 50.5; 343/713

(56) References Cited

U.S. PATENT DOCUMENTS

| | | | | |
|---|---|---|---|---|
| 2,365,518 A | | 12/1944 | Berkey et al. | |
| 4,171,500 A | * | 10/1979 | VAN Lieshout | 174/50.58 X |
| 4,266,260 A | | 5/1981 | Lange et al. | |
| 4,362,962 A | | 12/1982 | Lange | |
| 4,813,127 A | * | 3/1989 | Braski et al. | 174/50.58 X |
| 5,675,122 A | * | 10/1997 | Taylor | 174/50.58 |
| 5,986,613 A | * | 11/1999 | Weber | 174/94 R X |
| 6,410,854 B1 | * | 6/2002 | Vanhoutte et al. | 174/94 R X |

FOREIGN PATENT DOCUMENTS

| | | |
|---|---|---|
| EP | 0 034 360 | 11/1984 |
| FR | 2 430 084 | 1/1980 |

* cited by examiner

*Primary Examiner*—Dean A. Reichard
*Assistant Examiner*—Dhiru R. Patel
(74) *Attorney, Agent, or Firm*—Schiff Hardin & Waite

(57) ABSTRACT

In order to be able to produce an electrically conductive, positive connection between an end electrode of a gas-filled discharge path and a lead more simply in fabrication-oriented terms, the raised terminal region, which is provided at the end electrode, is provided with a blind hole into which the one end of the lead is introduced and joined thereat to the terminal region with a laser welding.

12 Claims, 2 Drawing Sheets

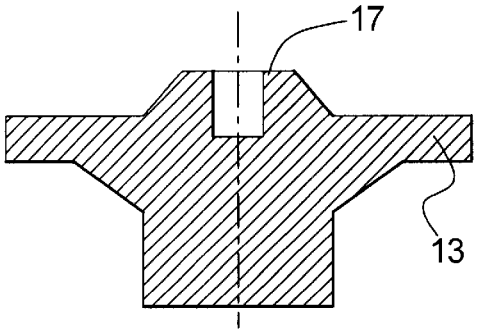
FIG. 3
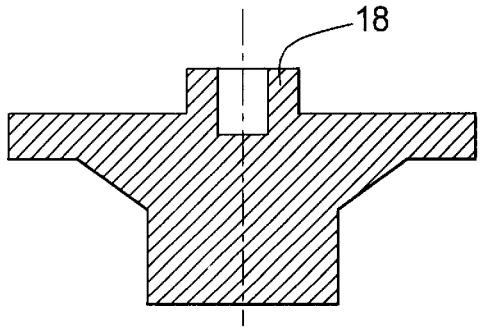
FIG. 4
FIG. 7
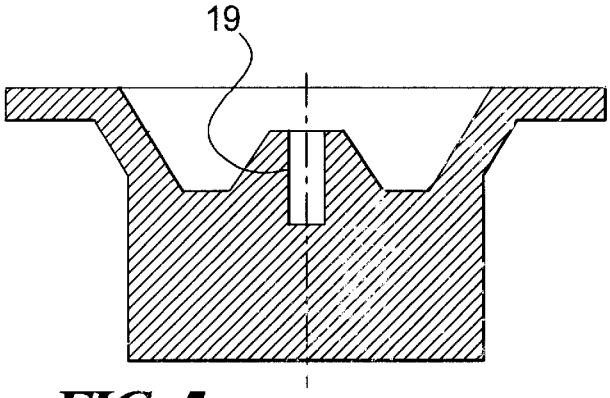
FIG. 5
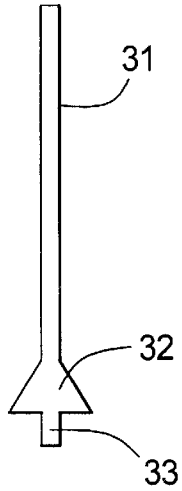
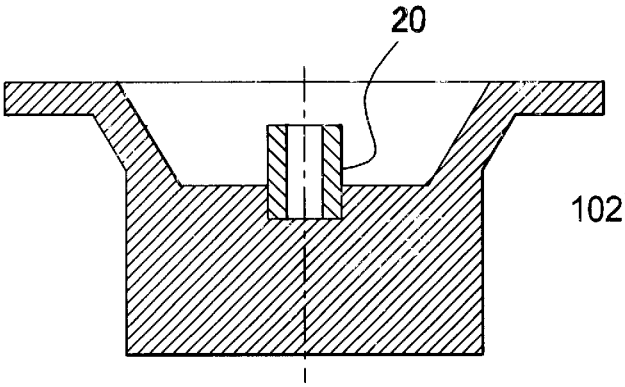
FIG. 6
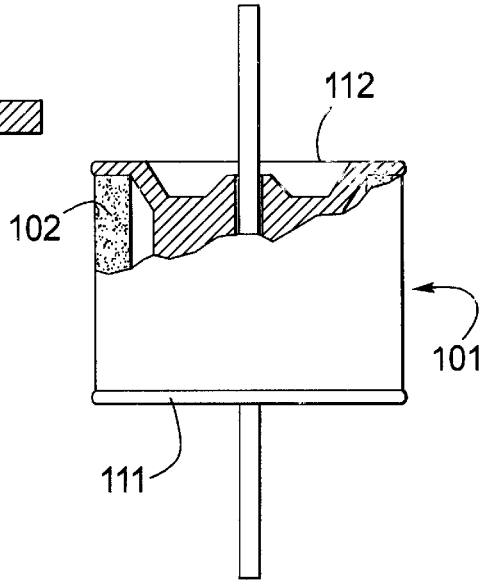
FIG. 8

ELECTRICALLY CONDUCTIVE CONNECTION BETWEEN A TERMINAL ELECTRODE AND A CONNECTING WIRE

BACKGROUND OF THE INVENTION

The invention is in the field of electrically conductive connections and is to be applied in the structural design of a welded connection between an end electrode of a gas-filled discharge path—like a surge arrester or a switching discharger—and a lead.

It is known in gas-filled surge arresters or gas-filled switching dischargers with end electrodes, which are fashioned cup-shaped, to provide the end electrodes (composed of copper) with a raised, peg-like terminal region that is arranged centrally relative to the solder flange of the end electrode in the cup-like depression of the electrode and the peg-like terminal region is integrally provided or formed with the electrode by extrusion during manufacture (U.S. Pat. No. 4,266,260 A). In order to assure a dependable positive connection between this terminal region and the one end of the lead by resistance welding, it is also known to dimension the raised terminal region in a specific way dependent on the diameter of the lead (EP 0 034 360 B1/U.S. Pat. No. 4,362,962 A). Relatively high currents, that cause considerable heating of the end electrode and thus also thermally load the adjacent solder point to the insulator, flow during manufacture of such welded connections. This connection technique, moreover, can hardly be applied given leads having a diameter <1 mm.

SUMMARY OF THE INVENTION

Proceeding from an electrically conductive connection between a lead and a raised terminal region of the electrode, the invention is therefore based on the object of designing the positive connection so that it can be more simply produced in fabrication-oriented terms and can also be utilized for wire diameters below 1 mm.

For achieving this object, it is inventively provided that the raised terminal region is provided with an axial blind hole, and that the lead has its one end introduced into the blind hole and is joined to the raised terminal region by laser welding. Expediently, a plurality of weld points are provided uniformly distributed over the circumference of the raised terminal region.

As a result of the known employment of a laser beam for supplying the welding energy, a positive connection fashioned in this way can be produced with very high reproducibility of the welding parameters and, accordingly, with dependable connection quality. The coaxialism between lead and solder flange of the electrode is thereby determined solely by the coaxialism of the blind hole relative to the solder hole. The production of the connection is accompanied by only a slight thermal load on the arrester. The new connection can thereby be utilized both for galvanically coated or non-coated electrodes of copper or of ferrous and non-ferrous alloys, particularly iron-nickel alloys, as well as for bare or nickel-coated or tinned copper wires, whereby a nickel or tin plating improves the degree of absorption for the laser light. Layer thicknesses from 1 through 100 $\mu$m come into consideration for the coating. A layer thickness of 6 $\mu$m has proven advantageous. It is thereby advantageous for the welding process that the laser beam can be very precisely positioned and dosed in view of its thermal energy. Thus, material from the dome of the raised terminal region is melted first during the welding and then unites with the subsequently melted material of the wire end.

The terminal region of the end electrode provided according to the invention can be cylindrically fashioned. However, a design as a conoidal frustum is advantageous because the laser beam can then be positioned so that it preferably impinges the generated surface of the conoidal frustum at a right angle so that an optimum heat absorption is established.

The dimensions of the conoidal frustum-shaped terminal region should lie within the following limits given wire diameters from 0.5 through 3 mm:

| | |
|---|---|
| Cone angle $\alpha$: | 30 through 80°, |
| Height h: | 0.2 through 3 mm, |
| Base diameter D: | 1 through 8 mm; |
| Frustum diameter d: | 0.5 through 7 mm; |
| Depth d of the blind hole: | 0.2 through 16 mm. |

Taking simple manufacturability of the end electrodes by cold extrusion into consideration, the blind hole should thereby be fashioned slightly conical.

Exemplary embodiments of the new welded connection are shown in the Figures and a modification of the design of that of a lead that is to be welded is also shown.

BRIEF DESCRIPTION OF THE DRAWINGS

FIG. 3 is a cross-sectional view of an embodiment of the end electrode of FIG. 2;

FIG. 4 is a cross-sectional view of a second embodiment of the end electrode of FIG. 2;

FIG. 5 is a cross-sectional view of a third embodiment of the end electrode of FIG. 2;

FIG. 6 is a cross-sectional view of a fourth embodiment of the end electrode of FIG. 2;

FIG. 7 is a side view of a modification of an end of a lead; and

FIG. 8 is a side view with portions broken away of a switching discharger with the improved welded connection according to the invention.

DESCRIPTION OF THE PREFERRED EMBODIMENTS

Figure 1:
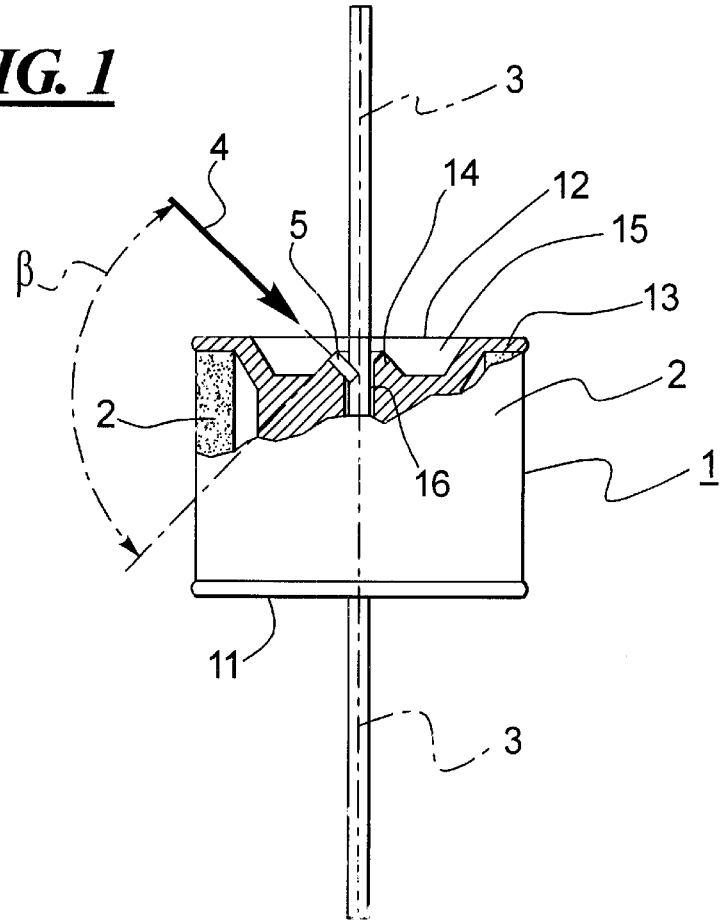
FIG. 1 is a side view with portions broken away of a gas-filled surge arrester with the improved welded connection according to the invention.

According to FIG. 1, a gas-filled surge arrester 1 that is composed of a ceramic insulator 2 and the two end electrodes 11 and 12 is provided with two leads 3 that are respectively axially and positively connected to the end electrodes 11 and 12. Each end electrode comprises a solder flange 13 and is provided with a raised terminal region 14 within a spherical or conical depression 15 which is located centrally relative to this solder flange and the welding location 5 is located in the terminal region 14. To this end, the raised terminal region 14 is provided with a blind hole 16 into which the one end of the lead is introduced. The raised terminal region 14 is fashioned as a conoidal frustum, whereby a laser beam 4 incident at an angle $\beta$ was directed onto the generated surface of the raised terminal region 14 for welding this terminal region to the lead 3.

Figure 2:
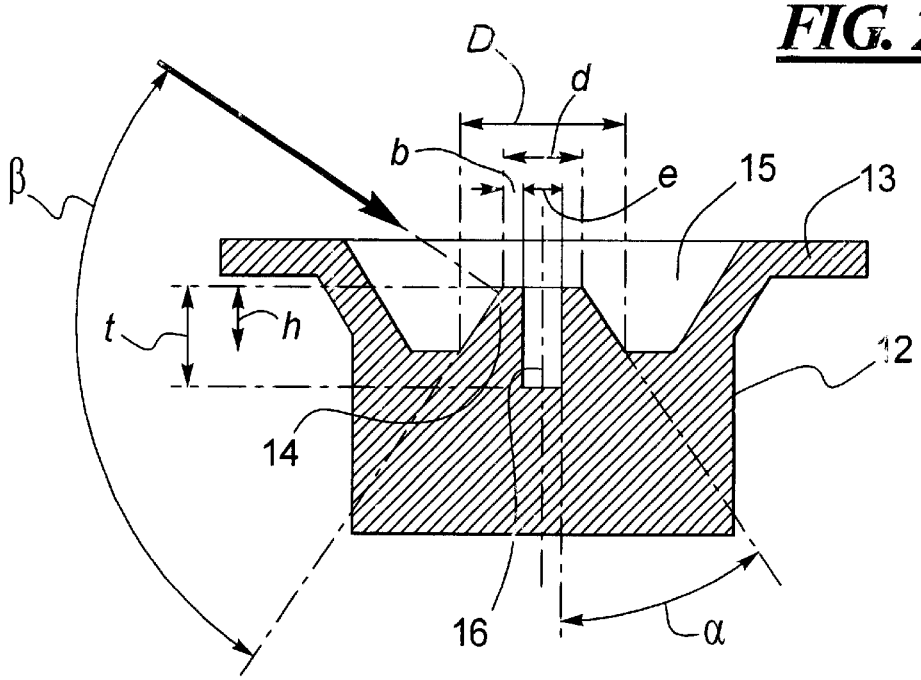
FIG. 2 is a cross-sectional view of an end electrode of FIG. 1.

According to FIG. 2, the terminal region 14, which is lying centrally and, thus, concentrically relative to the solder flange 13 of the end electrode 12, is characterized by the following parameters:

foot diameter D of region 14;

frustum diameter or top diameter d of the region 14;

depth t of the blind hole;

width b of the dome of the conoidal frustum;

height h of the raised terminal region;

whereby the base area of the actual electrode member forms the reference surface;

diameter e of the blind hole bore;

cone angle $\alpha$; and incident angle $\beta$ of the laser beam with reference to the generated surface of the conoidal frustum.

For a 1 mm diameter for the lead 3, the following values have proven expedient for the various parameters:

| | |
|---|---|
| Diameter D: | 3.3 mm |
| Diameter d: | 2 mm |
| Width b: | 0.4 mm |
| Height h: | 1.5 mm |
| Depth t: | 3 mm |
| Diameter e: | 1.05 mm |
| Cone angle $\alpha$: | 55° |
| Incident angle $\beta$: | 90° |

Deviating from the embodiment shown in FIG. 2, the raised terminal region 17 according to FIG. 3 can, given electrode bodies without a spherical cap or depression, form a conoidal frustum 17 projecting axially beyond the solder flange 13 or, according to FIG. 4, a truncated cylinder 18.

According to FIG. 5, the raised terminal region can also be fashioned such that the conoidal frustum 19 has a dome width of b equal to 0 mm.

According to FIG. 6, the raised terminal region can be fashioned as a hollow-cylindrical, bush-shaped insert 20 that is introduced or soldered into a corresponding bore of the electrode body.

According to FIG. 7, the wire end of the wire 31 to be soldered to the raised terminal region can be provided with a jolted nail head 32 and with a peg 33 in order to solder the wire to the terminal region, which is cylindrically designed according to FIG. 4 and comprises a relatively broad dome.

While FIG. 1 shows a gas-filled surge arrester 1 as an example of a gas-filled discharge path using the positive connection between a lead 3 and an electrode 11 or 12, another example is a switching discharger 101 having a ceramic insulator 102 and two electrodes 111 and 112, as shown in FIG. 8. The electrodes 111 and 112 have the same structure as the electrodes 11 and 12 of FIGS. 1 and 2.

What is claimed is:

1. An electrically conductive connection between an end electrode of a gas-filled discharge path, which is selected from a surge arrester and a switching discharger, and a lead, the end electrode having a solder flange and being provided with a raised terminal region located centrally relative to the solder flange, and the lead having one end positively connected to the raised terminal region, the improvement comprising the raised terminal region being provided with an axial blind hole; and the one end of the lead being introduced into the blind hole and being connected to the raised terminal region by means of a laser welding.

2. The electrically conductive connection according to claim 1, wherein the raised terminal region is fashioned as a conoidal frustum.

3. The electrically conductive connection according to claim 2, wherein the lead has a diameter from 0.2 through 3 millimeters; the conoidal frustum has a cone angle ( ) from 30 through 80, a height (h) from 0.2 through 3 millimeters, a base diameter (D) from 1 through 8 millimeters, and a frustum diameter (d) from 0.5 through 7 millimeters; and the axial blind hole has a depth (t) from 0.2 through 16 millimeters.

4. The electrically conductive connection according to claim 3, wherein the blind hole is slightly conical.

5. The electrically conductive connection according to claim 4, wherein both the electrode, at least in the terminal region, as well as the lead are provided with a galvanically applied coating selected from a group consisting of nickel and tin.

6. The electrically conductive connection according to claim 3, wherein at least the terminal region and the lead are provided with a galvanic coating selected from a group consisting of nickel and tin.

7. The electrically conductive connection according to claim 2, wherein the blind hole is slightly conical.

8. The electrically conductive connection according to claim 7, wherein at least the terminal region and the lead are provided with a galvanic coating selected from a group consisting of tin and nickel.

9. The electrically conductive connection according to claim 1, wherein the blind hole is slightly conical.

10. The electrically conductive connection according to claim 9, wherein the lead and at least the terminal region are provided with a galvanic coating selected from a group consisting of tin and nickel.

11. The electrically conductive connection according to claim 1, wherein the raised terminal region has a shape of a conoidal frustum and the terminal region and the lead are provided with a galvanic coating selected from a group consisting of tin and nickel.

12. The electrically conductive connection according to claim 1, wherein the terminal region and the lead have a galvanic coating selected from a group consisting of tin and nickel.

* * * * *